US005749110A

United States Patent [19]

Gamble et al.

[11] Patent Number: 5,749,110

[45] Date of Patent: May 12, 1998

[54] BOX SPRING WRAP AND DUST RUFFLE SYSTEM

[76] Inventors: Richard A. Gamble, 2501 Crestview Cir., Irving, Tex. 75602; Anthony V. Borino, 2221 High Country Dr., Carrollton, Tex. 75007

[21] Appl. No.: 782,402

[22] Filed: Jan. 13, 1997

[51] Int. Cl.[6] ..... A47C 21/00

[52] U.S. Cl. ..... 5/493; 5/923

[58] Field of Search ..... 5/493, 923, 922, 5/487

[56] References Cited

U.S. PATENT DOCUMENTS

| | | | |
|---|---|---|---|
| 2,139,980 | 12/1938 | Simon . | |
| 2,245,779 | 6/1941 | Meil | 5/493 |
| 2,639,444 | 5/1953 | Monsabert . | |
| 2,763,875 | 9/1956 | Piontkowski . | |
| 3,999,233 | 12/1976 | Morris . | |
| 4,141,097 | 2/1979 | Levinsohn et al. . | |
| 4,587,683 | 5/1986 | Gardiner | 5/493 |
| 4,807,316 | 2/1989 | Whipple | 5/493 |
| 4,865,015 | 9/1989 | Hasty et al. | 126/500 |
| 4,970,744 | 11/1990 | Davis | 5/496 |
| 4,979,251 | 12/1990 | Lazar | 5/496 |
| 5,046,207 | 9/1991 | Chamberlain | 5/496 |
| 5,205,003 | 4/1993 | Green | 5/493 |
| 5,271,112 | 12/1993 | Bible et al. | 5/493 |
| 5,335,383 | 8/1994 | Schwind | 5/493 |
| 5,353,456 | 10/1994 | Evans | 5/493 |

*Primary Examiner*—Alexander Grosz
*Attorney, Agent, or Firm*—Anderson, Levine & Lintel

[57] ABSTRACT

A box spring wrap and dust ruffle system is disclosed. The box spring wrap is fabricated of a material to which hooks, of a hook-and-loop fastener system, may be attached. The wrap has a length selected so that it is long enough to wrap around two sides and the foot of the perimeter of a large box spring, such as a king size; the wrap also preferably is of a length so as to be tied about the perimeter of a smaller size box spring, such as a full size or a queen size. Drawstrings are provided to secure the wrap around the box spring. The dust ruffle of the system has hook fasteners attached to the reverse side along the top, and thus may be attached at any height of the wrap when secured about a box spring.

10 Claims, 3 Drawing Sheets

BOX SPRING WRAP AND DUST RUFFLE SYSTEM

BACKGROUND OF THE INVENTION

This invention is in the field of bedding, and is more specifically directed to box spring covers and dust ruffles.

Conventional covers and dust ruffles are commonly used in connection with box spring and mattress sets for beds. As is well known, dust ruffles extend from the bed to the floor to decoratively cover the open space below the bed frame, and also to help prevent the gathering of dust under the bed. Especially in the home, conventional box spring covers are generally fabricated of a material to match the comforter and draperies of the bedroom; often, the dust ruffle is formed integrally with the box spring cover. Box spring covers and dust ruffles for home use are typically either made according to a standard size, or custom made to fit a specific bed.

In the hospitality industry, typical beds receive significant wear over time, particularly at the sides of box springs. Side wear of hotel bed box springs typically renders the box springs unsightly long before the support provided by the box springs begins to degrade. Conventional box spring covers are used in hotels to provide both a decorative appearance for the bed box springs, usually coordinated with the room decor, and also to provide wear protection for the box spring sides. Dust ruffles are also commonly used with hotel beds, to provide additional decorative accent and to inhibit the gathering of dust, as noted above Various dust ruffle and box spring or mattress covers are known in the art, such as described in U.S. Pat. No. 2,139,980, U.S. Pat. No. 2,763,875, U.S. Pat. No. 3,999,233, U.S. Pat. No. 4,141,097, U.S. Pat. No. 4,587,683, U.S. Pat. No. 4,807,316, U.S. Pat. No. 5,335,383, and U.S. Pat. No. 5,353,456. In particular, U.S. Pat. No. 5,205,003 describes a dust ruffle that is attachable by way of hook-and-loop fasteners to a box spring cover.

Of course, hotels typically include beds of various sizes, such as full, queen, and king. The arrangement of beds in a hotel can often change over time, depending upon changes in demand for beds of different types in the various rooms. In addition, it is not uncommon for box springs and mattresses to be moved among the hotel rooms, depending upon the particular needs for a given day or season. As a box spring is moved from room to room, the associated box spring cover and dust ruffle must be changed to match the decor of the new room. Accordingly, conventional box spring covers that are coordinated with a particular room decor and that are made to fit a particular sized bed may not fit a different size box spring. For interchangeability of conventional box spring covers in hotels, therefore, a significant inventory of box spring covers must be maintained, for each bed size and each room decor choice.

In addition, the bed frames or platforms may vary in height from the floor among the various rooms of the hotel. As such, custom dust ruffles that fit a particular box spring and frame may not fit when used in connection with a different box spring and frame. Accordingly, the hotel inventory of dust ruffles must also be enlarged for all foreseeable combinations of box spring size, frame height, and room decor. Such increase in inventory is expensive, and as such either adds to the cost of maintaining the hotel or results in box spring covers and dust ruffles not being used (thus impacting the appearance of the rooms).

By way of further background, a significant portion of the daily maintenance of guest rooms involves the "making" of the beds by chambermaids, including the daily changing of sheets. The time required to make each bed thus has a significant impact on the productivity of the chambermaids. Many conventional dust ruffles and box spring covers, particularly those where the dust ruffle hangs from between the mattress and the box spring, are easily disturbed by the changing of the bedsheets, and must then be repositioned by the chambermaid to provide the desired appearance. In addition, some conventional dust ruffles and box spring covers may require removal of the mattress for repositioning of the dust ruffle and cover. Furthermore, as the dust ruffles themselves require periodic laundering, conventional dust ruffles require the time-consuming and cumbersome removal of the mattress both for removal of the dust ruffle for laundering, and its replacement. As such, the daily room maintenance budget and schedule must account for the time required for the removal of mattresses in repositioning, removing, and replacing conventional dust ruffles.

BRIEF SUMMARY OF THE INVENTION

It is therefore an object of the present invention to provide a box spring cover that may be used in connection with box springs of multiple sizes.

It is a further object of the present invention to provide a box spring cover and dust ruffle system, in which the dust ruffle may be removed and repositioned without requiring removal of the overlying mattress.

It is a further object of the present invention to provide such a box spring cover and dust ruffle system in which the dust ruffle may be placed at varying heights, so as to allow the same dust ruffle to properly hang from beds of various platform or bed frame heights.

Other objects and advantages of the present invention will be apparent to those of ordinary skill in the art having reference to the following specification together with its drawings.

The present invention may be implemented into a box spring wrap that is a strip of material having drawstrings along its top and bottom edges. The length of the wrap is selected so that it may fit beds of varying sizes, such as full, queen, and king. The wrap may be attached to the box spring by tying the ends of the drawstrings, at both the top and bottom of the box spring, at the head end of the bed.

The present invention may also be implemented by way of such a box spring wrap that is formed of a material that serves as the loops in a hook-and-loop fastener system. A dust ruffle having hook fasteners along an edge may be attached to the box spring wrap at any height along the edge of the box spring so as to properly extend to the floor. Because the dust ruffle does not hang from between the mattress and box spring, it is not disturbed when the bedsheets are changed, and may be removed and replaced without removing the mattress from the bed.

DETAILED DESCRIPTION OF THE INVENTION

Figure 1:
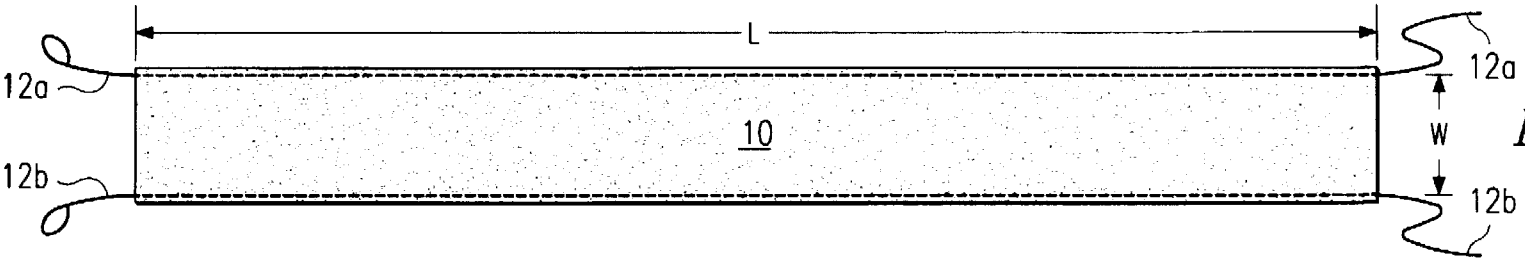
FIG. 1 is an elevation view of the box spring wrap according to the preferred embodiment of the invention.

Referring first to FIG. 1, the construction of box spring wrap 10 according to the preferred embodiment of the invention will now be described. As illustrated in FIG. 1, wrap 10 is a strip of material having a length L and a width W both selected according to the desired range of bed sizes with which wrap 10 is to be used. Wrap 10 is fabricated of a material that is itself useful as one side of a hook-and-loop fastening system, and preferably is of a loop fabric to which hook elements of a hook-and-loop fastener will strongly attach. According to the preferred embodiment of the invention, wrap 10 is fabricated of a knitted polyester material with a brushed finish, which is a readily available material in the textile field.

If desired, wrap 10 may be in a quilted form to add stability, durability and elasticity. An example of a quilted implementation of wrap 10 would include knitted polyester material, backed by a polyurethane foam, such as on the order of 3/16" thick, in combination with a non-woven backing. This quilted implementation of wrap 10 is preferred for many applications, as it will provide a tighter and more secure fit than a similarly sized non-quilted implementation.

Wrap 10 includes two drawstrings 12*a*, 12*b* each enclosed in a small pocket at the longitudinal hems of wrap 10 as is conventional for drawstrings. Drawstrings 12*a*, 12*b* are preferably fabricated of durable cord, such as 5 mm cord, and may have a loop at one end and a free end at the other, as shown in FIG. 1, for ease of tightening and tying, or may have two free ends if desired.

Width W of wrap 10 is selected so as to be slightly wider than the width of the box springs with which it is to be used, so that wrap 10 fully covers the sides of the box spring, with the drawstrings 12*a*, 12*b* secured at the top and bottom surfaces thereof. A preferred width W for standard box springs (of eight inch height) is twelve inches.

According to the preferred embodiment of the invention, wrap 10 is of a length L that is suitable for use in connection with multiple sizes of box springs. For example, the most common bed sizes in the hospitality industry are full, queen, and king size beds. In order to accommodate these box spring sizes, which vary from about 78 inches (width) by 80 inches (length) in the case of a king size box spring, to about 54 inches (width) by 74 inches (length) in the case of a full size box spring, a preferred length L of wrap 10 is about 240 inches. In this way, wrap 10 is long enough to wrap around two sides and the foot of the largest size with which it is useable (e.g., a king size box spring) but is not longer than the full perimeter of the smallest size with which it is useable (e.g., a full size box spring). Of course, in this example, wrap 10 is useable with intermediate sizes, such as queen size box springs.

Figure 2A:
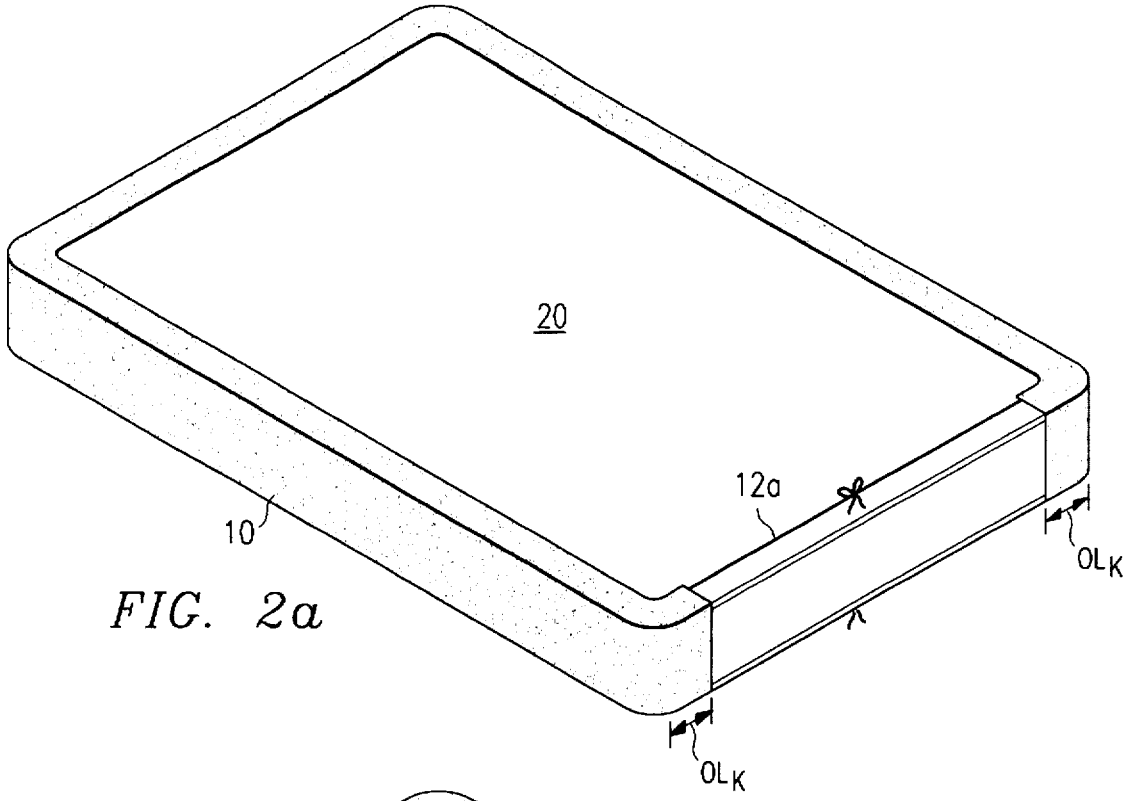
FIG. 2*a* is a perspective view, from the head end, of a king size box spring upon which the box spring wrap of the preferred embodiment of the present invention is installed.
Figure 2B:
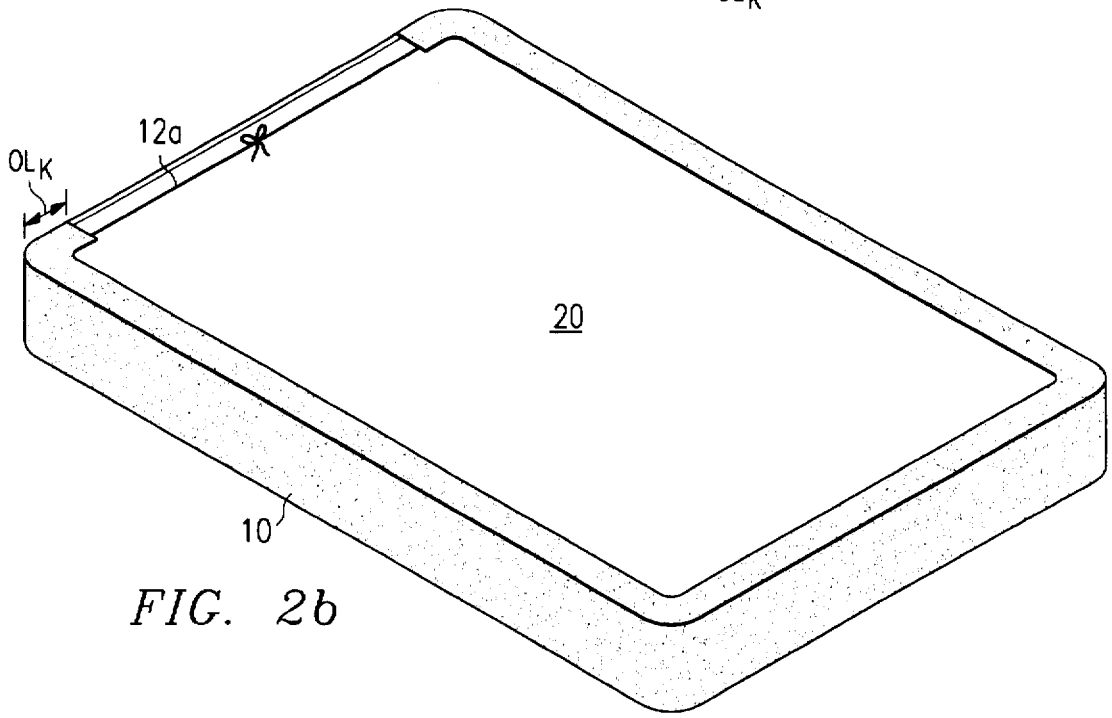
FIG. 2*b* is a perspective view, from the foot end, of the king size box spring upon which the box spring wrap of the preferred embodiment of the present invention is installed.

Referring now to FIGS. 2*a* and 2*b*, wrap 10 according to the preferred embodiment of the invention is illustrated as installed upon king size box spring 20. The view of FIG. 2*a* is from the head end of box spring 20, while the view of FIG. 2*b* is from the foot end of box spring 20. Because width W of wrap 10 is wider than the corresponding vertical height of box spring 10, the top and bottom hems of wrap 10 containing drawstrings 12*a*, 12*b* lie against the top and bottom surfaces of box spring 20. For the example of box spring 20 with a height of eight inches, wrap 10 having a width W of twelve inches will extend by two inches onto the top and bottom surfaces of box spring 20. The ends of drawstring 12*a* are tied together at the head end of box spring 20 on its top surface as shown in FIG. 2*a*; similarly, the ends of drawstring 12*b* are tied together at the head end of box spring 20 on its bottom surface (not visible in FIG. 2*a*).

As shown in FIGS. 2*a* and 2*b*, length L of wrap 10 is sufficient to fully cover both sides and the foot of box spring 20, and to overlap onto the head of box spring 20 by overlap $OL_k$ on each side. For the example where length L is 240 inches, overlaps $OL_k$ will be on the order of eight inches each. Accordingly, wrap 10 hides from view any worn or stained locations of the sides and foot of box spring 20, lengthening the useful life of box spring 20, especially in high traffic locations such as hotels where cosmetic wear of box spring 20 occurs prior to degradation of support. The gap left by wrap 10 at the head end of box spring 20 between overlaps $OL_k$ is typically hidden by the headboard of the bed, or by the wall of the room if no headboard is present, and as such is not in view.

Figure 3:
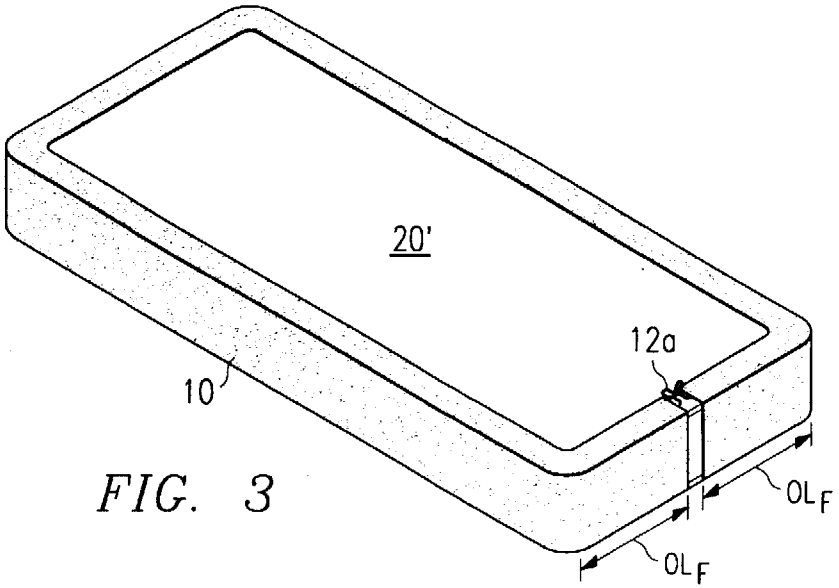
FIG. 3 is a perspective view of a full size box spring upon which the box spring wrap of the preferred embodiment of the present invention is installed.

Referring now to FIG. 3, wrap 10 is illustrated as installed upon full size box spring 20'. As in the case of king size box spring 20, width W of wrap 10 is wider than the vertical height of box spring 20', and thus the hems of wrap 10 lie upon the top and bottom surfaces of box spring 20'. The ends of drawstrings 12*a*, 12*b* are tied to one another on the top and bottom surfaces, respectively, at the head end of box spring 20', to secure wrap 10 thereupon.

Since full size box spring 20' is smaller than king size box spring 20, wrap 10 again covers the sides and foot of box spring 20° and overlaps the head of box spring 20' by overlaps $OL_f$ on each side, which are longer than overlaps $OL_k$ in the case of king size box spring 20. For the example where length L of wrap 10 is 240 inches, overlaps $OL_f$ for the full size box spring installation of FIG. 3 will be approximately 24 inches, such that wrap 10 substantially covers the full width of the head end of box spring 20'. Again, wrap 10 provides the function of hiding from view any wear or stains on box spring 20', extending its useful life.

As evident from the foregoing description, wrap 10 is suitable for use in combination with box springs of different sizes, including full, queen, and king size box springs. This permits a large volume owner of beds of various sizes, such as hotels, to purchase wraps 10 of a single size, easing the inventory control of wraps 10 as compared with box spring covers of custom sizes. In addition, wraps 10 may be re-used on new box springs, as beds are replaced.

As noted above, wrap 10 according to the preferred embodiment of the invention is fabricated of a material that serves as the loops of a hook-and-loop fastener combination, such as VELCRO fasteners. As such, a mating element with hook fasteners may be attached at any location along the entire width W of wrap 10, and thus at any position along the vertical height of the underlying box spring 20 when wrap 10 is installed thereupon. This provides important advantages when wrap 10 is used in combination with a dust ruffle, as will now be described.

Figure 4:
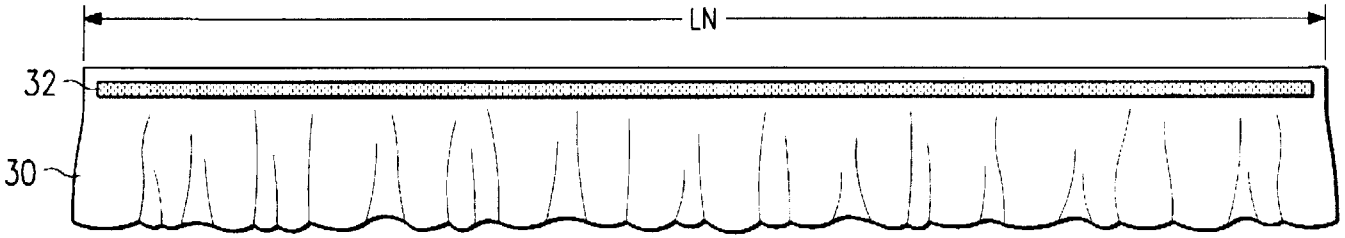
FIG. 4 is an elevation view of the reverse side of a dust ruffle according to the preferred embodiment of the invention.

FIG. 4 illustrates dust ruffle 30 according to the preferred embodiment of the invention, viewed from its reverse side. Dust ruffle 30 is fabricated of a material selected primarily for its decorative coordination with draperies, wall coverings, and other elements of the room in which it is to be used, and as such may be fabricated from a wide range of materials. Dust ruffle 30 has length LN corresponding to the cumulative length of the sides and foot of the bed system to which it is to be attached. It is contemplated that dust ruffle 30 will be constructed for a single size of bed, for example to fit a full, queen, or king size bed system, considering that the headboard or wall may prevent dust ruffle 30 from overlapping onto the head end of the box spring. For example, length LN for dust ruffle 30 intended for use with a king size bed may be approximately 224 inches, while length LN for a full size dust ruffle 30 may be approximately 192 inches.

Dust ruffle 30 has width H corresponding to the height at which dust ruffle 30 is to be attached above the floor of the room. As will be described in further detail hereinbelow, in hotels and other establishments in which dust ruffle 30 may be used on beds of varying frame or platform height, width H should be selected so as to be at least the distance from the floor to the bottom of the box spring of the highest bed, but no wider than the distance from the floor to the top of the box spring of the lowest bed. It is contemplated that these constraints will permit a useable range of widths H for dust ruffle 30.

As illustrated in FIG. 4, dust ruffle 30 has hook fasteners 32 attached as a strip near its top, on the reverse side of the material. Hook fasteners 32 are preferably attached as a continuous strip, as shown in FIG. 4, to provide a smooth and uniform attachment; alternatively, hook fasteners 32 may be attached periodically along the top of the reverse side of dust ruffle 30, if desired. Hook fasteners 32 are selected so as to securely attach to the material of wrap 10, as will now be described relative to FIGS. 5*a* and 5*b*.

Figure 5A:
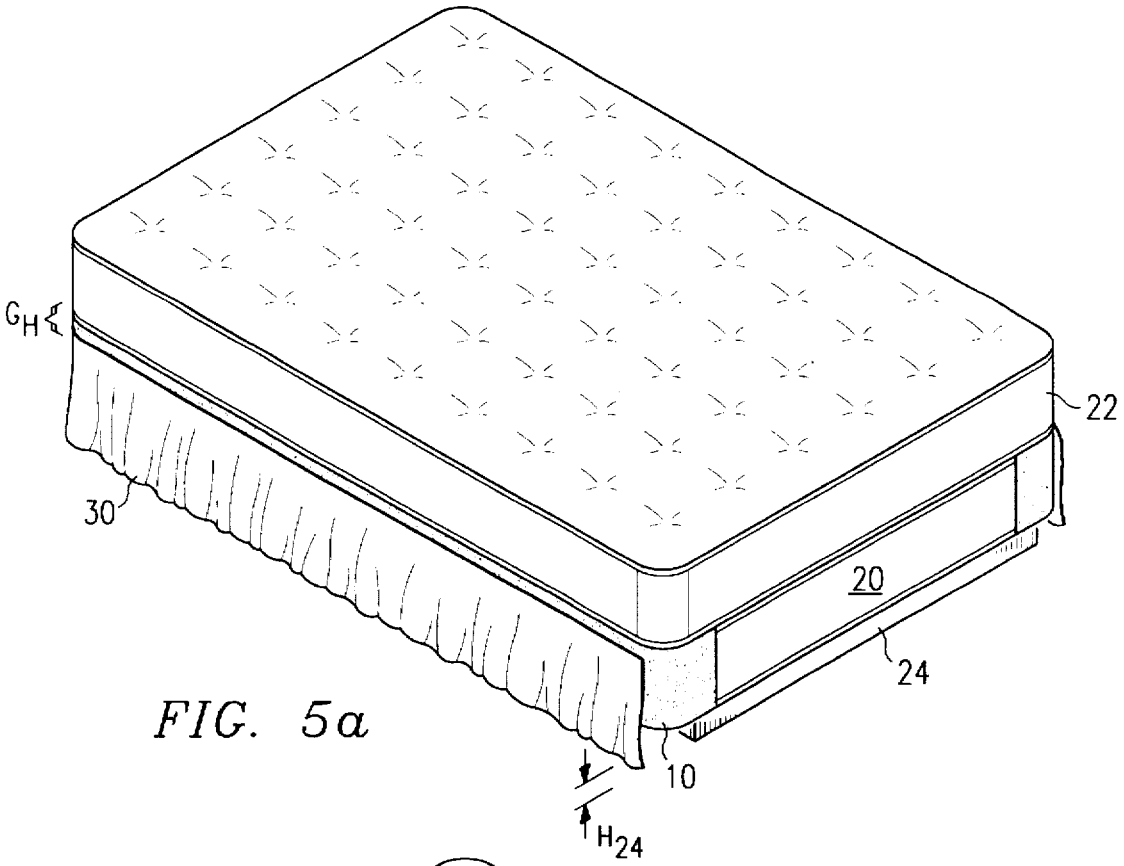
FIGS. 5*a* and 5*b* are perspective views of a box spring and mattress bed system upon which the box spring wrap and dust ruffle of the preferred embodiment of the present invention is installed upon bed platforms of varying height.

FIG. 5*a* illustrates an example of dust ruffle 30 as attached to wrap 10 as installed on a king size bed. In this example, king size box spring 20 is seated upon low platform 24; low platform 24 has a height of $H_{24}$ that is relatively low, such as on the order of two inches. King size mattress 22 is in place on top of box spring 20 in the usual manner. Wrap 10 is in place around box spring 20, secured in the manner described hereinabove relative to FIGS. 2*a* and 2*b*. The view of FIG. 5*a* is from the head end of the bed, and as such wrap 10 leaves a gap at the head end of box spring 20, as shown.

Dust ruffle 30 is attached to wrap 10 by pressing hook fasteners 32 on the reverse side (not visible in FIG. 5*a*) to wrap 10 at the appropriate height so as to fully extend to the floor, as shown in FIG. 5*a*. In this example, since platform 24 is relatively low, dust ruffle 30 is attached to wrap 10 near the top surface of box spring 20, leaving a relatively narrow gap $G_H$ between the top of dust ruffle 30 and the top surface of box spring 20.

As is evident from FIG. 5*a*, dust ruffle 30 may be readily attached to wrap 10, at the appropriate position, without requiring the removal of mattress 22 from the top of box spring 20. In addition, as is also evident from FIG. 5*a*, bedsheets may be placed onto and removed from mattress 22 without disturbing dust ruffle 30; even if dust ruffle 30 is inadvertently disturbed while changing the bedsheets or otherwise, dust ruffle 30 may be easily reattached to wrap 10, without requiring removal of mattress 22. Furthermore, in the event that the decor of the room is changed, one may readily replace the installed dust ruffle 30 with a new dust ruffle 30 of a different fabric or color, again without removing mattress 22 from box spring 20.

Figure 5B:
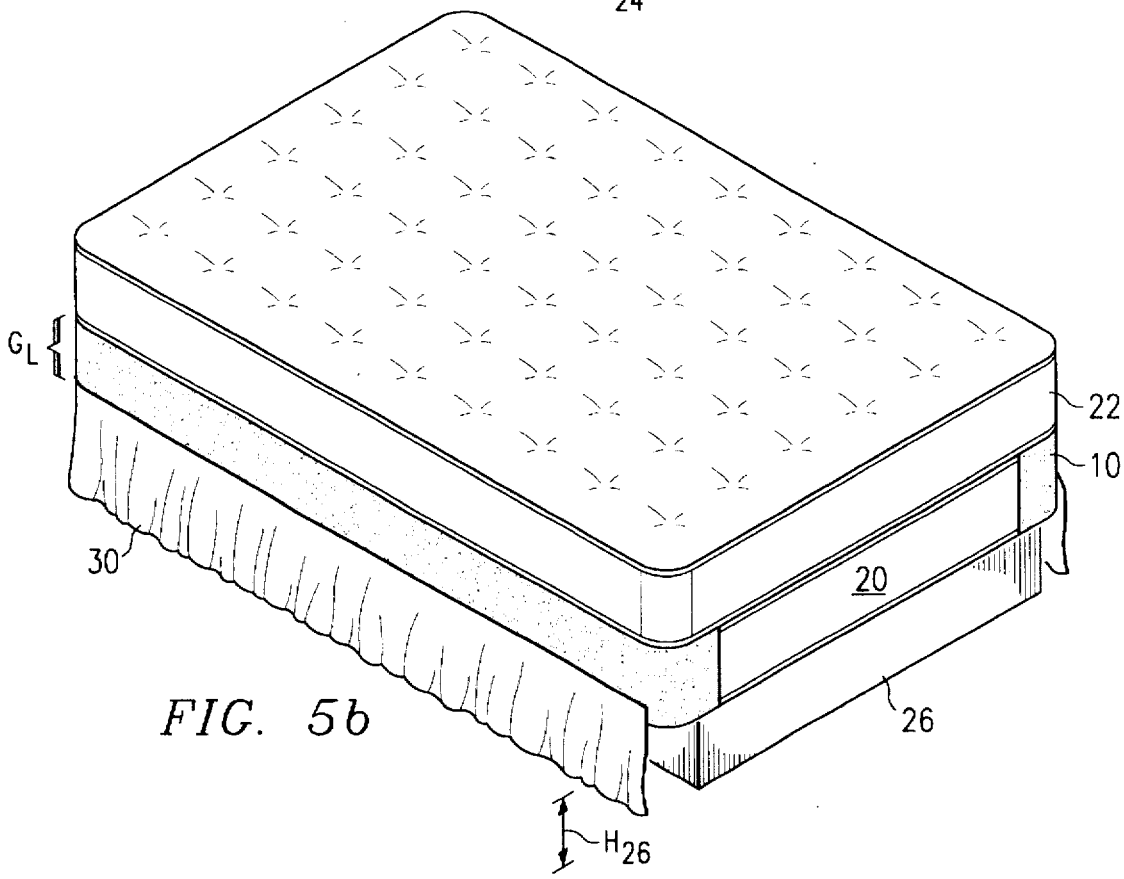

Referring now to FIG. 5*b*, an example of dust ruffle 30 as attached to wrap 10 in a king size bed on a higher platform 26 will now be described. In this example as in FIG. 5*a*, wrap 10 is secured to king size box spring 20, upon which king size mattress 22 rests. In this example, however, box spring 20 is placed on platform 26, which has a height $H_{26}$ that is higher than the height $H_{24}$ of platform 24 in FIG. 5*a*. For example, height $H_{26}$ may be on the order of six inches, as opposed to the two inch height $H_{24}$ of platform 24. In this example, dust ruffle 30 is again attached to wrap 10 by pressing hook fasteners 32 (not visible in FIG. 5*b*) to the fabric of wrap 10 at the appropriate height so that dust ruffle 30 extends to the floor as shown. Because of the increased height $H_{26}$ of platform 26, however, dust ruffle 30 is attached to wrap at a relatively low position, leaving a substantial gap $G_L$ as shown in FIG. 5*b*.

A comparison of FIGS. 5*a* and 5*b* illustrate important benefits provided according to the preferred embodiment of the invention. As is readily evident, dust ruffle 30 may be attached to wrap 10 at any position along the sides of box spring 20, permitting the same dust ruffle 30 to be installed upon on beds of various heights. In the example of FIG. 5*a*, dust ruffle 30 having a width H of nine inches would be installed on wrap 10 at a location one inch below the top surface of eight-inch thick box spring 20 to properly hang to the floor, leaving gap $G_H$ at one inch; for the same dust ruffle 30 and box spring 20 in the example of FIG. 5*b*, dust ruffle 30 would be installed on wrap 10 at five inches from the top surface of box spring 20 (i.e., gap GL would be six inches). As a result, the inventory requirements would be much reduced for the operators of large multiple-bed establishments, as box springs 20, 20' of various sizes and their associated dust ruffles 30 may be easily interchanged from room to room, without concern for the height of the platform or bed frame upon which they are installed.

Besides the ability to properly install dust ruffles always at the proper height, as described above, the dust ruffle according to the preferred embodiment of the invention may be easily removed and reattached without requiring removal of the mattress from the associated box spring. Furthermore, because according to the preferred embodiment of the invention, the dust ruffles may attach to the box spring wraps along the sides of the box springs, changing of the bedsheets and other bed maintenance are not only less likely to disturb the placement of the dust ruffles, but the reattachment of the dust ruffles is also quite simple. In addition, the dust ruffles according to the preferred embodiment of the invention will detach without tearing when accidentally stepped upon, in contrast to many styles of conventional dust ruffles which tear in such an event.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A box spring wrap and dust ruffle systems adapted to be used with any one of a plurality of box spring sizes, each of the plurality of box spring sizes having a height and a perimeter, wherein at least the perimeter of the plurality of box spring sizes differ from one another comprising:

a box spring wrap comprising a generally rectangular strip of material having a width that is wider than the height of each of the plurality of box spring sizes, and having a length that is longer than the length of two sides and a foot of a first one of the plurality of box spring sizes, and no longer than the perimeter of a second one of the plurality of box spring sizes, the second one of the plurality of box spring sizes being smaller than the first one of the plurality of box spring sizes; and a dust ruffle comprising:

a strip of decorative material, having a length corresponding to the length of two sides and a foot of one of the plurality of box spring sizes; and attaching means, located along an edge of the strip of decorative material, for attaching the dust ruffle to the box spring wrap at any location of the wrap.

2. The system of claim 1, wherein the attaching means of the dust ruffle comprises hook fasteners;

and wherein the material of the box spring wrap is a loop fabric to which the hook fasteners are attachable.

3. The system of claim 2, wherein the material of the box spring wrap is a knitted polyester material.

4. The system of claim 1, wherein the first one of the plurality of box spring sizes is standard king size, and wherein the second one of the plurality of box spring sizes is standard full size.

5. The system of claim 1, wherein the box spring wrap further comprises:

first and second drawstrings, each having a length longer than the length of the wrap, and attached to the box spring wrap along first and second sides thereof.

6. A box spring wrap and dust ruffle system adapted to be used with any one of a plurality of box spring sizes, each of the plurality of box spring sizes having a height and a perimeter, wherein at least the perimeter of the plurality of box spring sizes differ from one another, the system adapted to cover at least two sides and a foot of any one of the box spring sizes, comprising:

a dust ruffle comprising:

a strip of decorative material, having a length corresponding to the length of two sides and a foot of one of the plurality of box spring sizes; and hook fasteners, located along an edge of the strip of decorative material; and a box spring wrap comprising a generally rectangular strip of material having a width that is wider than, the height of each of the plurality of box spring sizes and having an outer surface comprised of a loop fabric to which hook fasteners of a hook-and-loop fastening system are attachable at any location along the width of the wrap.

7. The system of claim 6, wherein the box spring wrap has a length that is longer than the length of two sides and a foot of a first one of a plurality of box spring sizes, and no longer than the perimeter of a second one of the plurality of box spring sizes, the second one of the plurality of box spring sizes being smaller than the first one of the plurality of box spring sizes.

8. The system of claim 7, wherein the first one of the plurality of box spring sizes is standard king size, and wherein the second one of the plurality of box spring sizes is standard full size.

9. The system of claim 6, wherein the material of the box spring wrap is a knitted polyester material.

10. The system of claim 6, wherein the box spring wrap further comprises:

first and second drawstrings, each having a length longer than the length of the box spring wrap, and attached to the box spring wrap along first and second sides thereof.

* * * * *